United States Patent [19]

Wenger

[11] 3,977,178

[45] Aug. 31, 1976

[54] WATCH WINDING CROWN ASSEMBLY

[75] Inventor: Karl Wenger, Chambesy, Switzerland

[73] Assignee: Boninchi S.A., Switzerland

[22] Filed: July 9, 1975

[21] Appl. No.: 594,231

[30] Foreign Application Priority Data

Aug. 20, 1974 Switzerland ..... 11320/74

[52] U.S. Cl. ..... 58/90 B; 58/63; 58/85.5; 58/88 B

[51] Int. Cl.[2] ..... A63F 1/18

[58] Field of Search ..... 58/23 R, 63, 80, 85.5, 58/88 R, 88 B, 88 C, 90 R, 90 B

[56] References Cited

UNITED STATES PATENTS

| | | | |
|---|---|---|---|
| 3,357,173 | 12/1967 | Wissen | 58/63 |
| 3,389,550 | 6/1968 | Piquerez | 58/88 R |
| 3,535,869 | 10/1970 | Zellveger | 58/90 B |
| 3,621,649 | 11/1971 | Vullan et al | 58/90 B |

*Primary Examiner*—L. T. Hix
*Assistant Examiner*—Vit W. Miska
*Attorney, Agent, or Firm*—Robert E. Burns; Emmanuel J. Lobato; Bruce L. Adams

[57] ABSTRACT

In a watch winding crown assembly of the type with a push-button axially displaceable relative to a crown body, the crown body has an integral cylindrical shank slidably and rotatably mounted in a pendant tube, with an interposed annular seal. The push button has a cylindrical head and shank guided in corresponding cylindrical parts of a through bore in the crown head and in its skirt, this skirt terminating with an inner shoulder in which part of the shank is keyed. A spring in the skirt acts against this shoulder and, in addition to outwardly biasing the push-button, compresses a further annular seal between the push-button and the skirt. The outer position of the push-button is defined by a widened terminal part of its shank abutting against said shoulder, this terminal part being secured to a winding stem.

4 Claims, 1 Drawing Figure

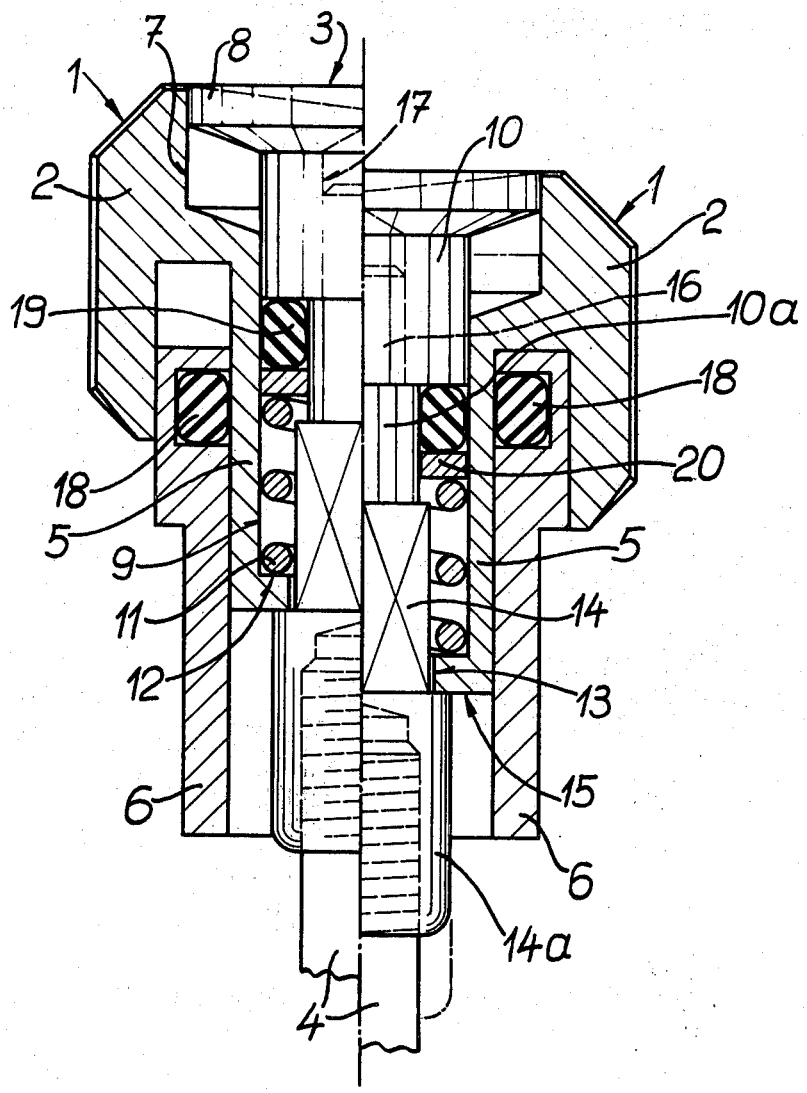
7
8
3
1
17
10
2
1
2
16
19
10a
18
18
20
5
9
5
11
14
12
13
15
6
6
14a
4

WATCH WINDING CROWN ASSEMBLY

The invention concerns winding crown assemblies to be fitted to a winding stem of a watch, of the type in which a crown head is provided with a central push-button to permit axial displacement of the stem in the pushed-in position of the crown to actuate an additional mechanism, such as for rapidly setting the date of a calendar.

Various crown assemblies of this type are known. One known arrangement comprises a crown body having an axial through-bore, the first part of which has a non-circular cross-section and the second a cylindrical cross-section of a diameter greater than the dimensions of the first part. A push button comprises a non-circular head keyed in the first part of said bore, and a cylindrical shank in the second part. A spring located in said second part of the axial bore of the crown biases the push button toward the head of the crown to press the shank against a shoulder of the crown body located between the first and second parts of its bore. The assembly is thus arranged so that the push button is fixed with the crown body for rotational movement but can be moved axially independently of the crown, the bearing of the shank against the said shoulder preventing the push button from projecting beyond the surface of the crown body.

Such an assembly has disadvantages which it is the object of the present invention to surmount. A first disadvantage stems from the fact that no sealing device is provided to protect the inner part of the crown and its push-button and spring; water and/or dust may thus penetrate into this assembly and produce jamming and rusting of the spring. A second disadvantage is that the crown is guided on the push button by a cylindrical part of very shallow depth, and is consequently unstable. Finally, the non-circular first part of the bore in the push button has to be milled and the corresponding part of the crown stamped out, which are two costly operations.

According to the invention, a watch winding crown assembly comprises a pendant tube; a crown body having an integral cylindrical skirt slidably and rotatably mounted in the pendant tube, the crown body having a central through bore with a first cylindrical part opening into a top of the crown body, a second cylindrical part extending through said skirt, said second part being of lesser diameter than said first part, and a non-circular end part through an inwardly-directed shoulder towards the end of said skirt; a push-button slidably mounted in said bore of the crown body, the push-button having a head axially displaceable in said first part of the bore, a cylindrical part axially slidably mounted and guided in said second part of the bore, a narrowed part including a non-circular portion keyed in said end part of the bore, and a terminal part wider than said end part of the bore and able to abut against said shoulder of the skirt to define an outermost position of the push-button in relation to the crown body; a spring mounted within said second part of the bore and acting against said shoulder and the push button to bias the push button towards its outermost position; a first annular seal between the pendant tube and the crown body; and a second annular seal between the push-button and said second part of the bore.

In use, the terminal part of the push-button shank is secured to the winding stem of a watch, and the pendant tube secured in an aperture in the watch case.

The accompanying drawing shows, by way of example, an embodiment of the invention.

The single FIGURE of the drawing shows two half axial cross-sections of a watch winding crown assembly, the left-hand part showing a pulled-out position of the crown, and the right hand part a pushed-in position of the crown.

The crown 1 shown in the drawing has a crown head 2 provided with a central push-button 3 able to axially move a winding stem 4. Crown head 2 has an inner cylindrical skirt 5 slidably mounted in a pendant tube 6 to guide the crown during this movement. The crown 1 has a central through bore comprising:

1. a first cylindrical part 7 for a cylindrical head 8 of push-button 3;
2. a second cylindrical part 9, of lesser diameter than the first part 7, and which serves to house and guide a cylindrical part 10 of the shank of push-button 3 and also houses a coil spring 11, for biasing the push-button 3; and
3. an end part or passageway 13 through an inwardly-directed bearing shoulder 12 at the end of skirt 5, this passageway 13 being of non-circular section and receiving a part 14 of corresponding shape of the push-button to key the crown 1 and push-button 3 for rotation together.

The push-button 3 also has a terminal cylindrical part **14*a* wider than the non-circular passageway 13 of skirt 5, and which abuts against the lower face 15 of the skirt to define an outermost axial rest position of push-button 3. Part 14*a* has a tapped bore in which winding stem 4** is screwed.

The crown head 1 is knurled on its outer surface to facilitate manual rotation and has an outer cylindrical skirt surrounding the upper part of pendant tube 6.

An annular seal 18 is mounted in a groove in the pendant tube 6 facing the outer face of skirt 5, and provides a seal between the skirt 5 and the pendant tube 6. A second annular seal 19 is mounted in an annular groove on a narrowed cylindrical part **10*a* of the push-button shank between a shoulder delimiting shank parts 10 and 10*a* and a washer 20 biasing spring 11 acting against push-button 3 via washer 20 and seal 19**.

To mount the push-button 3 in the skirt 5 of crown 1, a part of the push-button shank formed by a stud 16 and parts **10*a*, 14 and 14*a* is inserted through opening 13 until part 14*a* abuts against the lower face 15 of skirt 5. The spring 11, washer 20 and seal 19 are there inserted from above and stud 16 is force-fitted in a blind hole 17 provided in part 10 of the shank of push-button 3. This tight force-fitting may be reinforced by cement. It would alternatively be possible to provide a thread on stud 16 and a tapped bore 17, or to rivet the end of stud 16 in a through-bore 17 of the push-button part 10**.

In the pushed-in position of the crown 1, shown in the right-hand part of the drawing, when the push-button 3 is pressed, it takes the position shown in a chain line. This enables actuation, in known manner, of a supplementary mechanism such as one for actuating a date ring for example.

When the crown 1 is pulled out to the position shown in the left-hand part of the drawing, stem 4 can be turned by crown head 2 to wind the watch, for example.

What is claimed is:

1. A watch winding crown assembly comprising: a pendant tube; a crown body having an integral cylindrical skirt slidably and rotatably mounted in the pendant tube, said crown body having enlarged top end and a narrow skirt end with an inwardly-directed shoulder in the skirt towards said skirt end, the crown body further having means defining a central through bore with a first cylindrical part opening into said top end of the crown body, a second cylindrical part extending through said skirt, said second part being of lesser diameter than said first part, and a non-circular end part through said inwardly-directed shoulder; a push-button slidably mounted in said bore of the crown body, the push-button having a head axially displaceable in said first part of the bore, a cylindrical part axially slidably mounted and guided in said second part of the bore, a narrowed part including a non-circular portion keyed in said end part of the bore, and a terminal part wider than said end part of the bore and able to abut against said shoulder of the skirt to define an outermost position of the push-button in relation to the crown body; a spring mounted within said second part of the bore and acting against said shoulder and the push-button to bias the push button towards an outermost position relative to said crown body; a first annular seal between the pendant tube and the crown body; and a second annular seal between the push-button and said second part of the bore.

2. An assembly as claimed in claim 1, in which the crown body has a second outer skirt surrounding the pendant tube.

3. An assembly as claimed in claim 1, in which the first seal is housed in means defining a groove in the pendant tube facing an outer face of said skirt.

4. An assembly as claimed in claim 1, in which the second annular seal is located in an annular housing defined by a shoulder delimiting said cylindrical and narrowed parts of the push-button, a cylindrical portion of said narrowed part of the push-button, and a washer mounted on said cylindrical portion, the biasing spring acting against the push-button via said washer and the second annular seal.

* * * * *